US006223478B1

(12) United States Patent
Wheeler

(10) Patent No.: US 6,223,478 B1
(45) Date of Patent: May 1, 2001

(54) WALL PANEL SYSTEM

(75) Inventor: Kenneth L. Wheeler, Goshen, IN (US)

(73) Assignee: DO Groups Inc., Elkhardt, IN (US)

( * ) Notice: Subject to any disclaimer, the term of this patent is extended or adjusted under 35 U.S.C. 154(b) by 0 days.

(21) Appl. No.: 09/327,725

(22) Filed: Jun. 8, 1999

(51) Int. Cl.[7] ..... A47F 10/00
(52) U.S. Cl. ..... 52/36.1; 52/239; 52/220.7
(58) Field of Search ..... 52/36.1, 238.1, 52/220.1, 243.1, 220.7, 239

(56) References Cited

U.S. PATENT DOCUMENTS

| | | | | |
|---|---|---|---|---|
| Re. 31,733 | | 11/1984 | Haworth et al. . | |
| 3,195,698 | | 7/1965 | Codrea . | |
| 3,462,892 | | 8/1969 | Meyer . | |
| 3,567,842 | | 3/1971 | Meyer . | |
| 4,031,675 | | 6/1977 | Roberts et al. . | |
| 4,060,294 | | 11/1977 | Haworth et al. . | |
| 4,133,153 | * | 1/1979 | Hage | 52/220.7 |
| 4,370,008 | | 1/1983 | Haworth et al. . | |
| 4,596,098 | * | 6/1986 | Finkbeiner | 52/220.7 |
| 4,616,798 | | 10/1986 | Smeenge et al. . | |
| 4,630,416 | * | 12/1986 | Lapins | 52/239 |
| 4,631,881 | | 12/1986 | Charman . | |
| 5,038,539 | | 8/1991 | Kelley et al. . | |
| 5,065,556 | | 11/1991 | DeLong et al. . | |
| 5,160,276 | | 11/1992 | Marsh et al. . | |
| 5,172,529 | | 12/1992 | Van De Riet . | |
| 5,277,005 | | 1/1994 | Hellwig et al. . | |
| 5,277,006 | | 1/1994 | Ruster . | |
| 5,277,007 | | 1/1994 | Hellwig et al. . | |
| 5,303,320 | * | 4/1994 | Duffie | 385/135 |
| 5,341,615 | | 8/1994 | Hodges et al. . | |
| 5,357,055 | | 10/1994 | Sireci . | |
| 5,362,923 | | 11/1994 | Newhouse et al. . | |
| 5,487,246 | * | 1/1996 | Hodges | 52/220.7 |
| 5,675,949 | | 10/1997 | Forslund et al. . | |
| 5,719,933 | | 2/1998 | Welch . | |
| 5,778,612 | * | 7/1998 | Kissinger | 52/220.7 |
| 5,784,843 | | 7/1998 | Greer et al. . | |
| 5,804,763 | | 9/1998 | Smeenge . | |
| 5,806,258 | | 9/1998 | Miedema et al. . | |
| 5,831,211 | * | 11/1998 | Gartung | 174/48 |
| 5,852,904 | * | 12/1998 | Yu | 52/239 |
| 5,881,500 | | 3/1999 | Latino et al. . | |
| 5,974,742 | * | 11/1999 | Schreiner | 52/36.1 |

OTHER PUBLICATIONS

Manual entitled "VersaCable, Modular Pre–manufactured Telecommunication System for the Open Office," Revision 3, Jan. 3, 1998, Dekko Engineering.

2–sided piece of advertising literature for "VersaCable™, A Modular Telecommunications Solution for the Open Office, "Dekko Engineering , undated.

2–sided piece of advertising literature "Modu–Comm®Modular Communications," Domore/DO3, undated.

* cited by examiner

*Primary Examiner*—Carl D. Friedman
*Assistant Examiner*—Kevin McDermott
(74) *Attorney, Agent, or Firm*—Barnes & Thornburg

(57) ABSTRACT

A wall panel includes two vertical channels and a horizontal channel communicating with the vertical channels. Race ways are provided on the top and bottom edges of the panel. Multiple wall panels may be arranged to form office work stations. A power/communications junction assembly is provided at least partially within the horizontal channel. The assembly may extend into one of the vertical channels. Communications ports, fiber optics ports and/or electrical outlets are provided in the assembly. Power lines, communications lines and fiber optics cables may be attached to the outlets and ports and fed through the channels and race ways. In this manner, power and communications may be provided to the work stations as desired.

52 Claims, 11 Drawing Sheets

WALL PANEL SYSTEM

BACKGROUND AND SUMMARY OF THE INVENTION

The present invention relates to a wall panel and to a wall panel system of the kind often used in offices to create work stations, sometimes called "cubicles." In particular, the present invention relates to a wall panel and wall panel system that provides access to power, voice communications and/or data communications at the work station.

Modular wall panel systems are well known. Such systems often include a number of panels that may be interconnected to form office work stations. The panels can often be configured in a number of different ways. This allows the office environment to be reconfigured as needed to accommodate additional employees as well as the departure of employees.

The present invention provides a wall and wall panel system. According to one embodiment of the present invention, a wall panel includes a top edge, a bottom edge, a first side edge, a second side edge, first and second raceways, first and second vertical channels communicating with the first and second raceways and a horizontal channel communicating with the first and second vertical channels. The vertical channels may be located along the side edges of the panel. The race ways may be located along the top and bottom edges of the panels. A junction assembly may be located partially within the horizontal channel or partially within the horizontal channel and partially within one of the vertical channels. The junction assembly may include communications ports, fiber optics ports and/or electrical outlets. A core member can be located between the first raceway, the first vertical channel, the second vertical channel and the horizontal channel. A skin may cover the channels.

According to another embodiment of the present invention, a wall panel includes a top edge, a bottom edge, a first vertical channel, a second vertical channel, a horizontal channel and at least one communications port located in the horizontal channel. A communications line may extend from the communications port, through the horizontal channel and into at least one of the vertical channels. The communications line may extend out of the vertical channel and may include a connector. An electrical outlet may be provided in the horizontal channel. A power line may extend from the electrical outlet, through the horizontal channel and into at least one of the vertical channels. The power line may extend out of the vertical channel and may include a connector. The wall panel may also include a fiber optics port, located in either the horizontal channel or one of the vertical channels. A fiber optics cable may likewise extend through the horizontal channel and into one of the vertical channels. The ports and outlets may be located in a junction assembly positioned in the horizontal channel or partially in the horizontal channel and partially in one of the vertical channels.

According to another embodiment of the invention, a wall panel system includes a first panel having at least two vertical channels and at least one horizontal channel communicating with the vertical channels, a second panel located adjacent the first panel, a first race way at least partially located above the first and second panels, a second race way at least partially located below the first and second panels, a communications port and an electrical outlet located in the horizontal channel, a first communications line located in the first race way, a first power line located in the second race way, a second communications line extending from the communications port, through the horizontal channel, through one of the vertical channels and into the first race way, and a second power line extending from the electrical outlet, through the horizontal channel, through one of the vertical channels and into the second raceway. The first power line and first communications lines may enter the system from above or below the panels, as desired.

The race ways used in the various embodiments of the invention may engage the top edges of the panels and may be removed therefrom as a unit. The race way may include a removable cap.

Other features of the present invention will be apparent to those skilled in the art from the following detailed description of the preferred embodiments and the accompanying drawings.

DETAILED DESCRIPTION OF THE DRAWINGS

Figure 1:
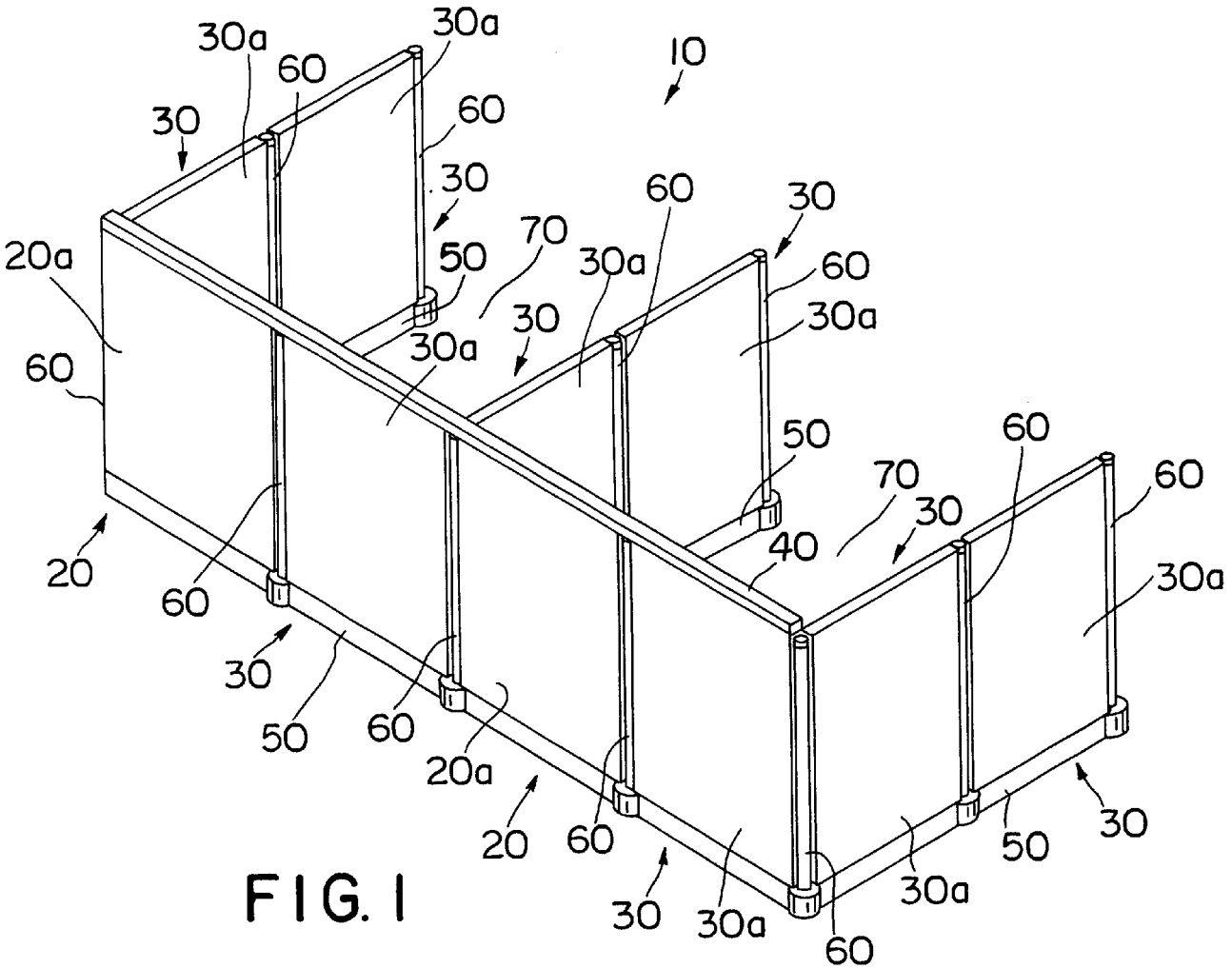
FIG. 1 shows one configuration of office work stations utilizing wall panels according to one embodiment of the present invention.

FIG. 1 illustrates a wall panel system utilizing wall panels according to one embodiment of the present invention. System 10 generally includes a plurality of first wall panels 20, a plurality of second wall panels 30, a first race way 40, a second race way 50 and supports or posts 60. In the embodiment shown, wall panels 20 and 30 are arranged to form two work stations 70.

Figure 2:
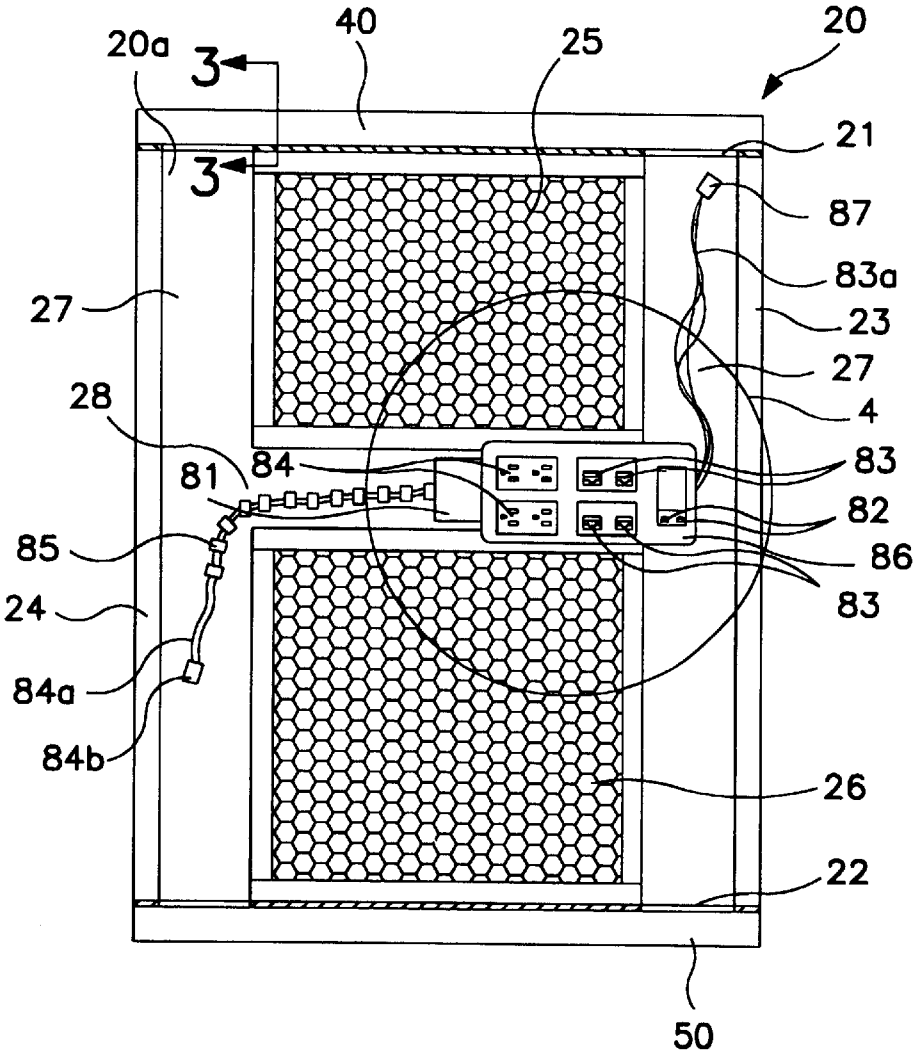
FIG. 2 shows a front elevational view of a wall panel according to one embodiment of the present invention with the outer skin removed from one side of the panel.

FIG. 2 shows a front elevational view of one wall panel 20 with its outer covering or skin 20*a* removed from one side. In the embodiment shown in FIG. 2, wall panel 20 includes a top edge 21, a bottom edge 22, a first side edge 23 nd a second side edge 24. In the embodiment shown, skins 20*a* are continuous members that extend from top edge 21 to bottom edge 22. A first core member 25 and a second core member 26 are located between skins 20*a* so as to form first and second vertical channels 27 and a horizontal channel 28. In the embodiment shown, each vertical channel 27 communicates at one end with first race way 40 and at the other end with second race way 50. Each vertical channel 27 also communicates with horizontal channel 28.

Race way 40 (FIG. 3) generally includes a base 41, a pair of walls 42, a cover 43, a first pair of legs 44 and a second pair of legs 45. Cover 43 may be removed from walls 42 to provide access to the interior 46 of first race way 40. Cover 43 may be held in place in any one of a number of manners, such as by an interference fit. First legs 44 include, in the embodiment shown, a notch 44*a*. Notches 44*a* rest on top edge 21 of wall panel 20. In the embodiment shown, second legs 45 extend from the junction of base 41 and walls 42 below first legs 44 and contact skins 20*a*. Second legs 45 provide additional stability to race way 40. They may also be designed so as to provide a decorative trim element to the panel system. With the embodiment shown, a race way 40 may be positioned on top of any panel 20 or 30 as desired.

Power/communications junction assembly 80 (FIGS. 2, 4–7) generally includes, in the embodiment shown, a junction box 81, fiber optics ports 82, communications ports 83, electrical outlets 84, conduit 85 and face plates 86. Box 81 includes a first end 81*a* and a second end 81*b*. Electrical outlets 84 are contained in box 81. Face plates 86, in the embodiment shown, partially overlap second end 81*b* of box 81. Face plates 86 include openings that receive communications ports housings 83*b* and fiber optics ports housings 82*b*. Fiber optics ports 82, communications ports 83 and electrical outlets 84 may be provided on both sides of assembly 80. Fiber optics ports 82 are adapted to be connected to fiber optics cables 82*a*. Communications ports 83 can be used for voice and/or data communications, such as phone lines, fax lines, data transmission lines for computers and similar items. Any number of different electrical outlets 84 may be utilized. Conduit 85 is attached to box 81 and can be of any type, including flexible metal conduit.

Communications lines 83*a* may extend from communications ports 83, through horizontal channel 28 and into one of the vertical channels 27. A connector 87 may be connected to the free ends of communications lines 83*a*. In similar fashion, power lines 84*a* extend through conduit 85 in horizontal channel 28 and into vertical channel 27. Communications lines 84*a* may be provided with a connector 84*b*.

Note that fiber optics cables 82*a* may also extend through horizontal channel 28 and into vertical channel 27. However, in the embodiment shown in FIG. 2, assembly 80 is placed within horizontal channel 28 such that fiber optics ports 82 extend into one of the vertical channels 27. This placement of assembly 80 permits fiber optics cable 82*a* to be secured to ports 82 without sharply bending cable 82*a*. This reduces the likelihood that cable 82*a* will be damaged.

Face plates 86 are sized with respect to box 81 such that face plates 86 extend beyond box 81 and form a flange. Face plates 86 are positioned such that openings in face plates 86 expose fiber optics ports 82, communications ports 83 and electrical outlets 84 and are secured on the outside surface of and to skins 20*a* covering core members 25 and 26 by screws or other fasteners.

Figure 12:
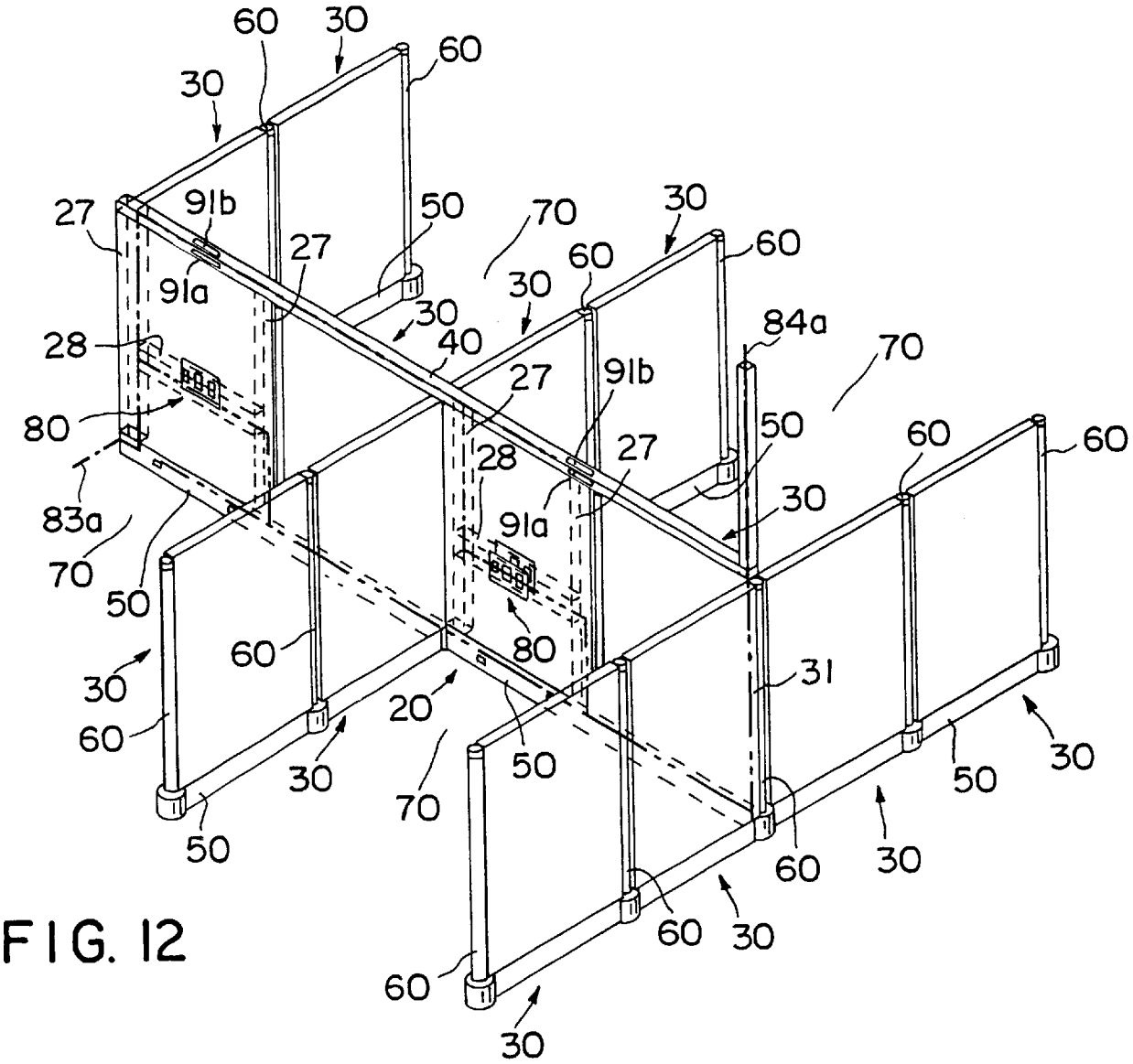
FIG. 12 shows another configuration of office work stations utilizing wall panels according to one embodiment of the present invention, as well as a wiring configuration for the system according to one embodiment of the present invention.

Panels 20 and 30 may be joined in any number of configurations to form work stations 70. FIGS. 1 and 12 show two such configurations. In both of these embodiments, panels 20 and 30 are joined by posts 60. Any of a number of posts 60 that are commonly known in the art may be used to join panels 20 and 30. Alternative methods of joining panels 20 and 30, such as directly connecting or interlocking the panels, may also be utilized.

System 10 may be provided with fiber optics cables 82*a*, communications lines 83*a* and power lines 84*a* in any one of a number of ways. For example, individual fiber optics cables 82*a*, communications lines 83*a* and power lines 84*a* could be connected directly between each fiber optic port 82, communications port 83 and outlet 84 to a telephone closet, computer network, power supply, etc. without using any intervening connectors. In such a system, boxes 81 and face plates 86 could be installed at the office site during wiring. Fiber optics cables 82*a*, communications lines 83*a* and power lines 84*a* would be run through channels 27 and 28 as well as race ways 40 and 50.

Figure 3:
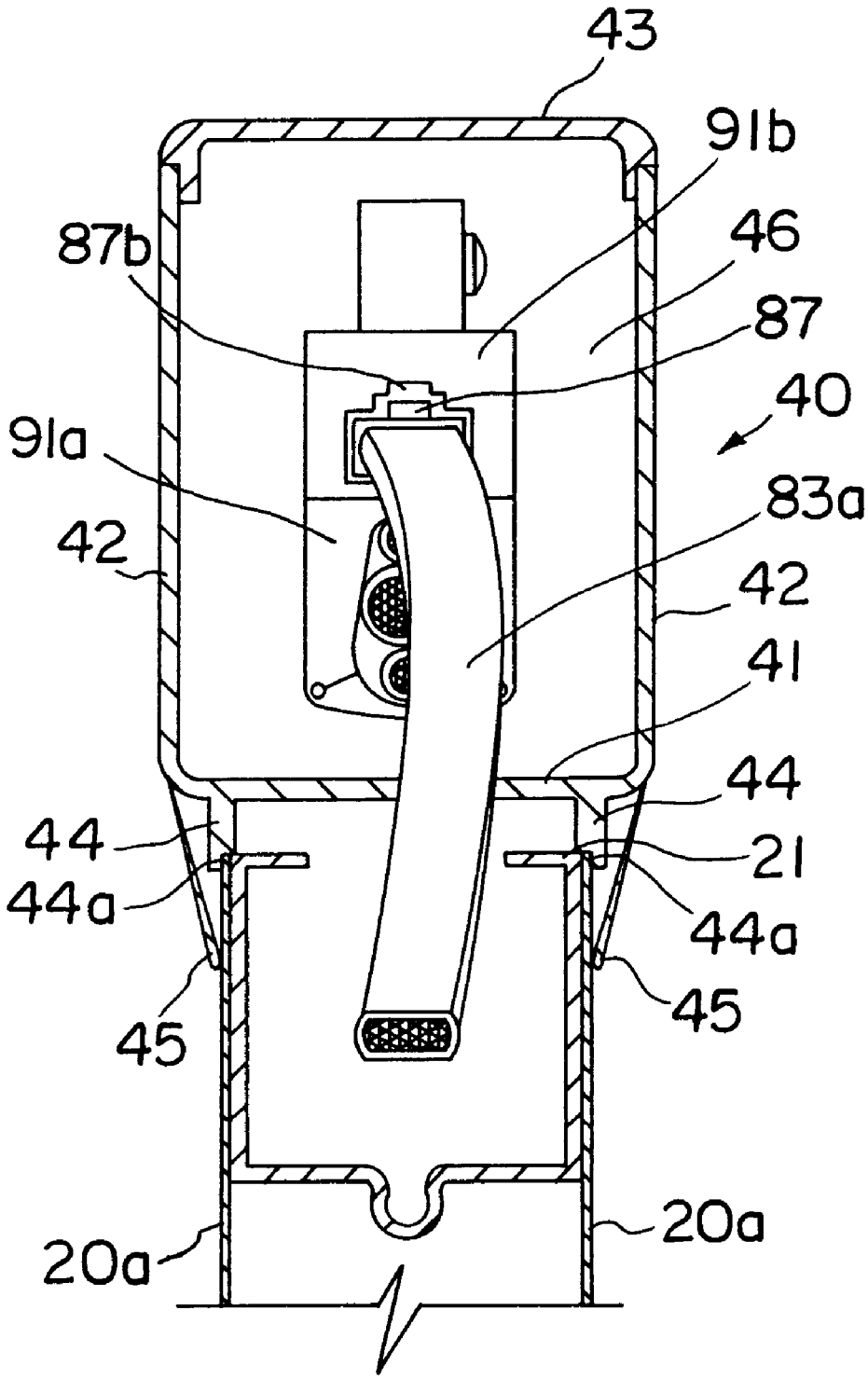
FIG. 3 is a cross-sectional view taken along line 3—3 in FIG. 2.
Figure 4:
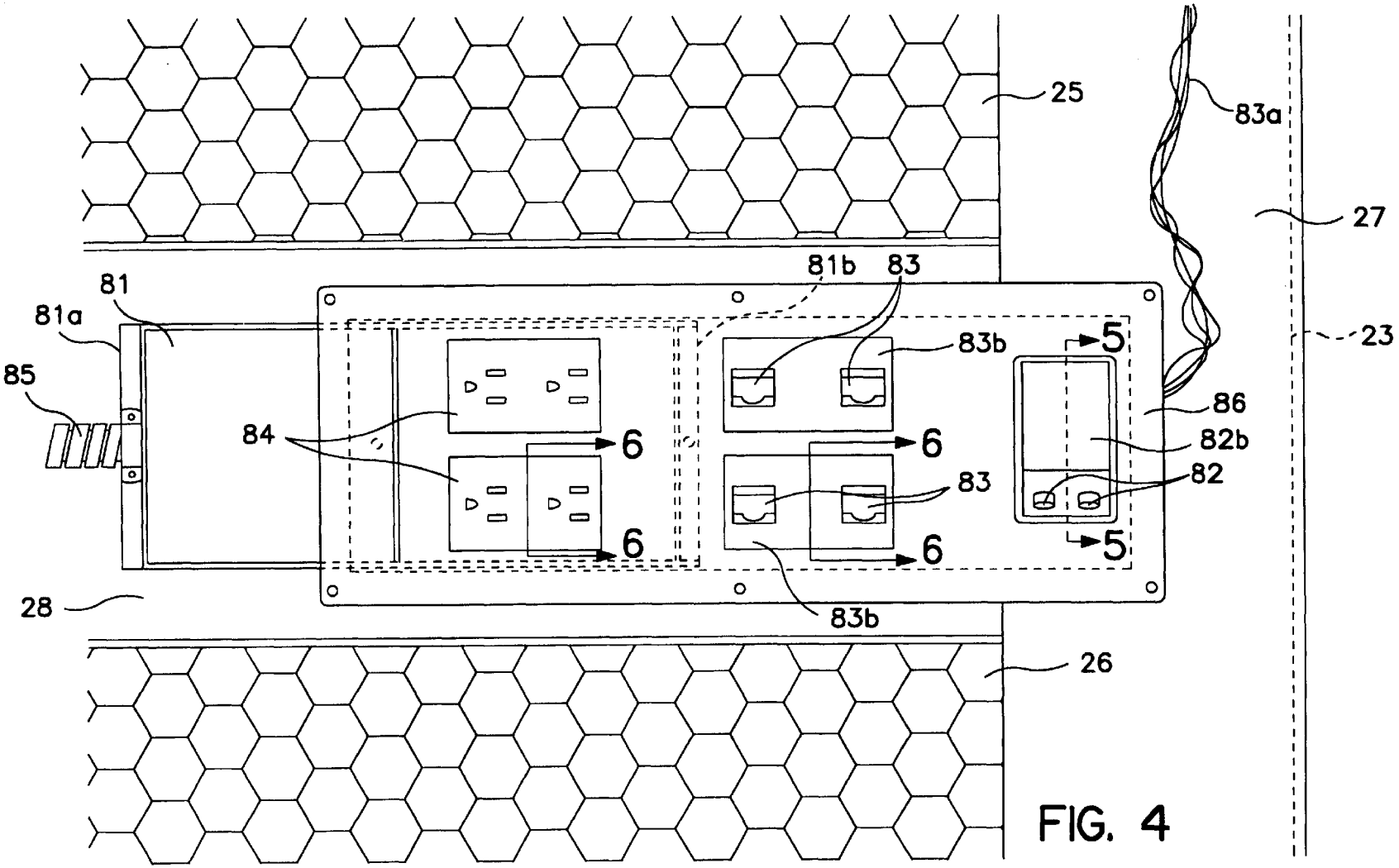
FIG. 4 shows the detail of circle 4 in FIG. 2, which is a front elevational view of a power/communications junction assembly according to one embodiment of the present invention.
Figure 7:
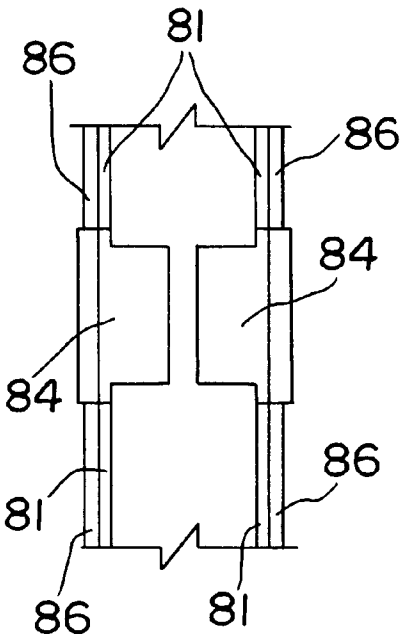
FIG. 7 is a cross-sectional view taken along line 7—7 in FIG. 4.
Figure 6:
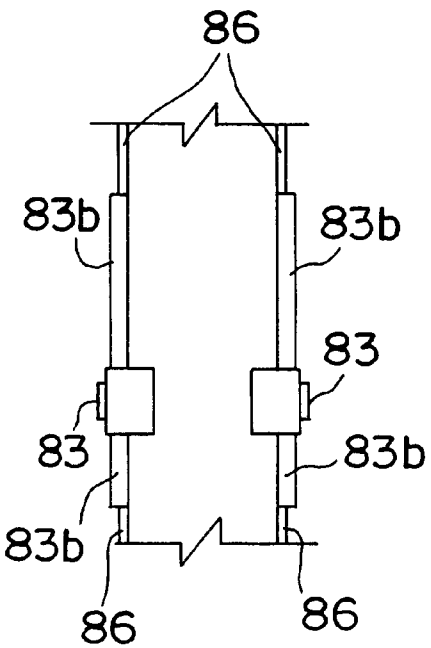
FIG. 6 is a cross-sectional view taken along line 6—6 in FIG. 4.
Figure 5:
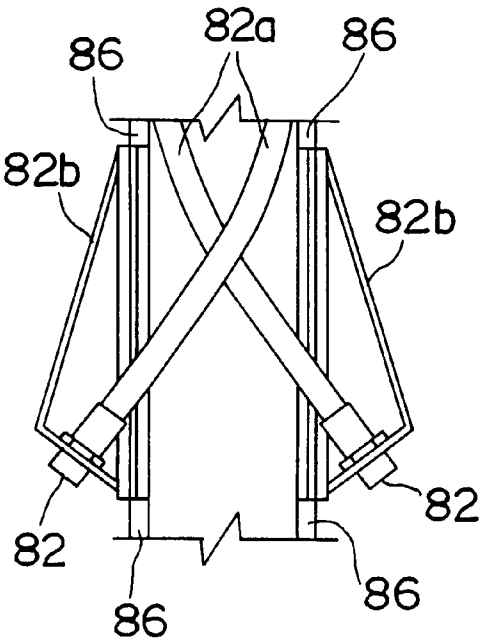
FIG. 5 is a cross-sectional view taken along line 5—5 in FIG. 4.

Alternatively, panels 20 may be supplied to the office site with assemblies 80 already installed, as shown in FIG. 2. Communications lines 83*a* and power lines 84*a* (as well as fiber optics cables 82*a*) could be connected at one end to their respective ports and outlets and at the other end to connectors, such as connectors 87 and 84*b* shown in FIG. 2. In one embodiment, sufficient lengths of lines 83*a* and 84*b* are provided so that connectors 87 and 84*b* can extend into race ways 40 and 50. Connectors 84*b* can then be joined to power lines in one of the race ways. Similarly, connectors 87 can be joined with any one of a number of interconnectable, modular wiring systems to provide communications to work stations 70. For example, a system such as that shown in U.S. Pat. No. 5,160,276 or 5,719,933, the disclosures of which are hereby incorporated by reference, could be utilized. In such systems, modular cables 90 containing communications lines 83*a* are provided at one end with female connectors 91*a* and at the other end with male connectors 91*b* for interconnecting cables 90. At least one of the connectors, such as connector 91*b*, includes a connector 87*b* for mating with connectors 87 (FIGS. 3 and 8*a*). FIGS. 8–12 illustrate such systems.

Figure 8:
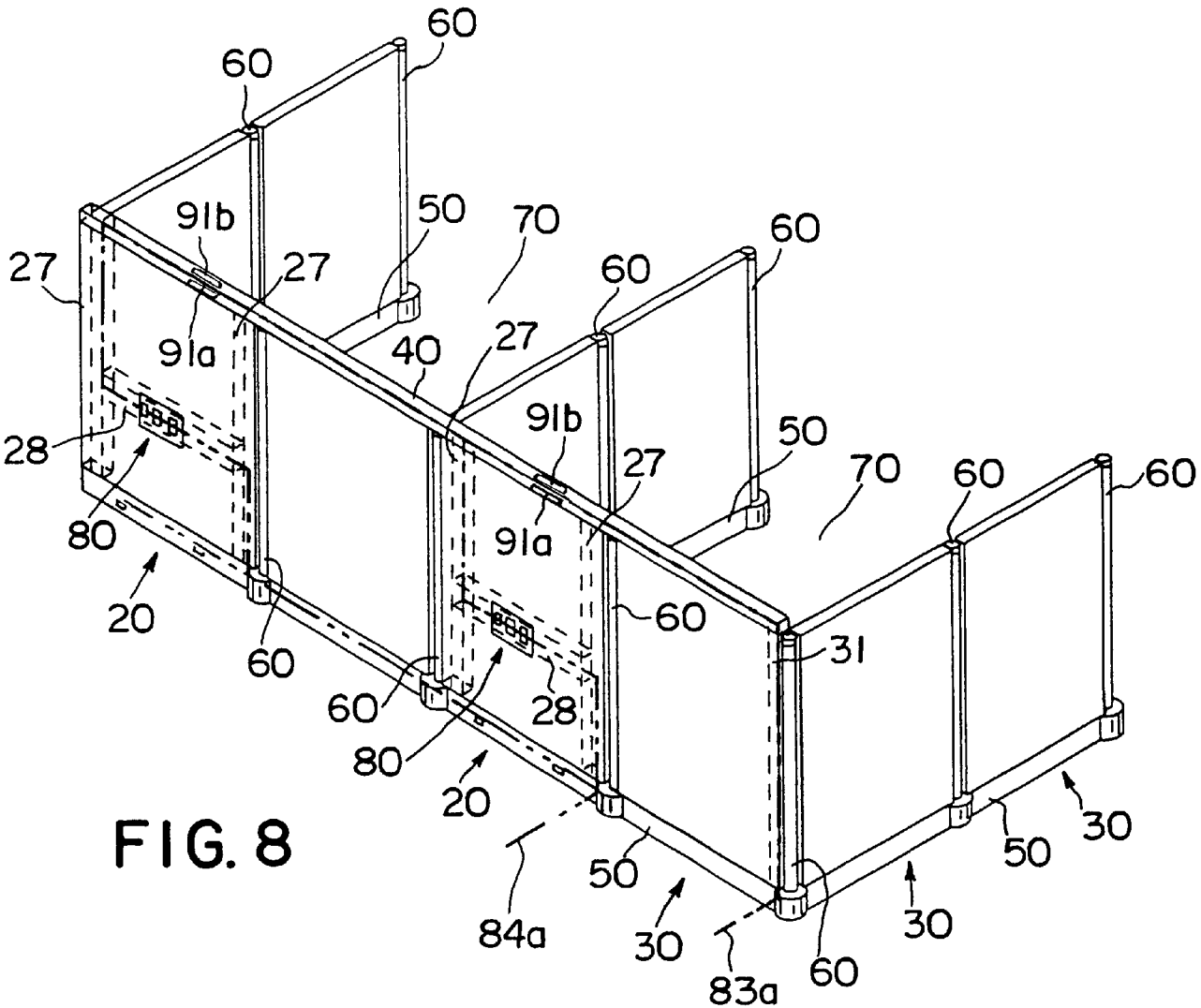
FIG. 8 shows one wiring configuration according to an embodiment of the present invention for the wall panel system shown in FIG. 1.
Figure 8A:
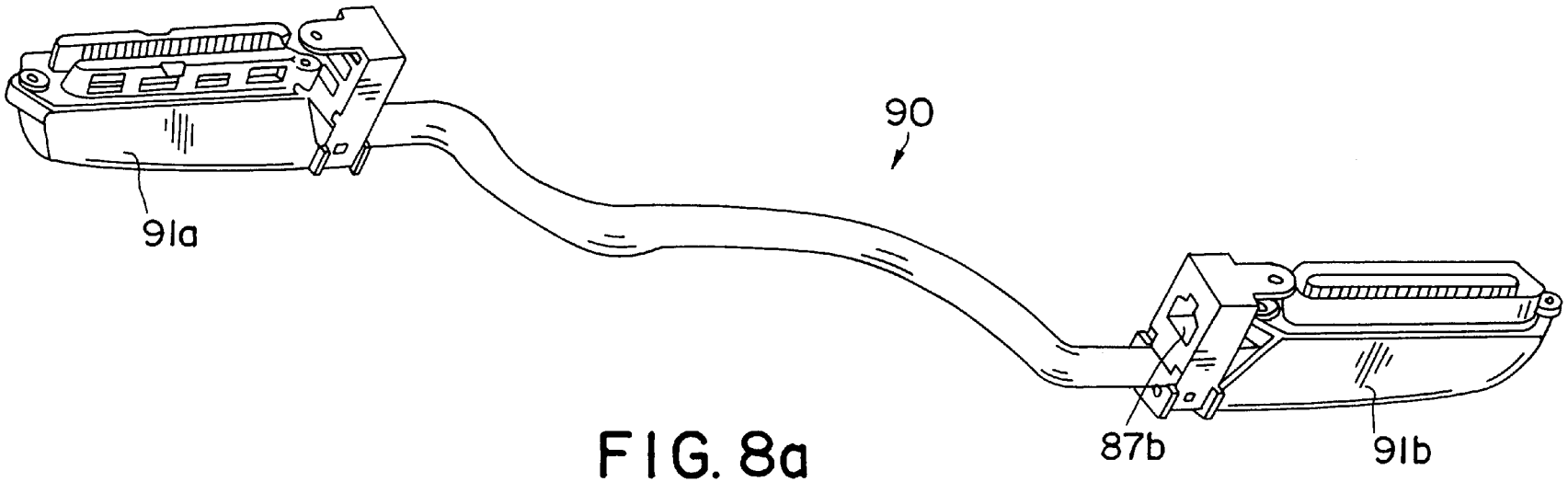
FIG. 8*a* shows a perspective view of a modular cable that may be used to provide access to communications lines at work stations in one embodiment of the present invention.

In FIG. 8, communications lines 83*a* enter race way 50 from beneath the floor, extend upwardly through vertical channel 31 in a panel 30 and along race way 40. Cables 90 including lines 83*a* may be interconnected within race way 40 by connectors 91*a* and 91*b*. At each work station 70 where access to communications lines 83*a* is desired, connector 87*a* is mated with connector 87*b*. Fiber optics cables 82*a* could be connected in a similar manner by providing appropriately configured connectors and cables.

As shown in FIG. 8, power lines 84*a* also enter race way 50 from below the floor. At each work station 70 where access to power lines 84*a* is desired, connectors 84*b* are joined to the power lines in race way 50. Note that in this manner, communications lines 83*a* and power lines 84*a* are separated from one another, thereby lessening interference between the two. Note also that in the embodiment shown in FIGS. 8–12, assembly 80 is placed in the center of channel 28. However, if fiber optics cables 82*a* are used, it may be desirable to move assembly 80 to the position shown in FIG. 2 so that the fiber optics cables can be connected to port 90 without bending the cables sharply.

Figure 9:
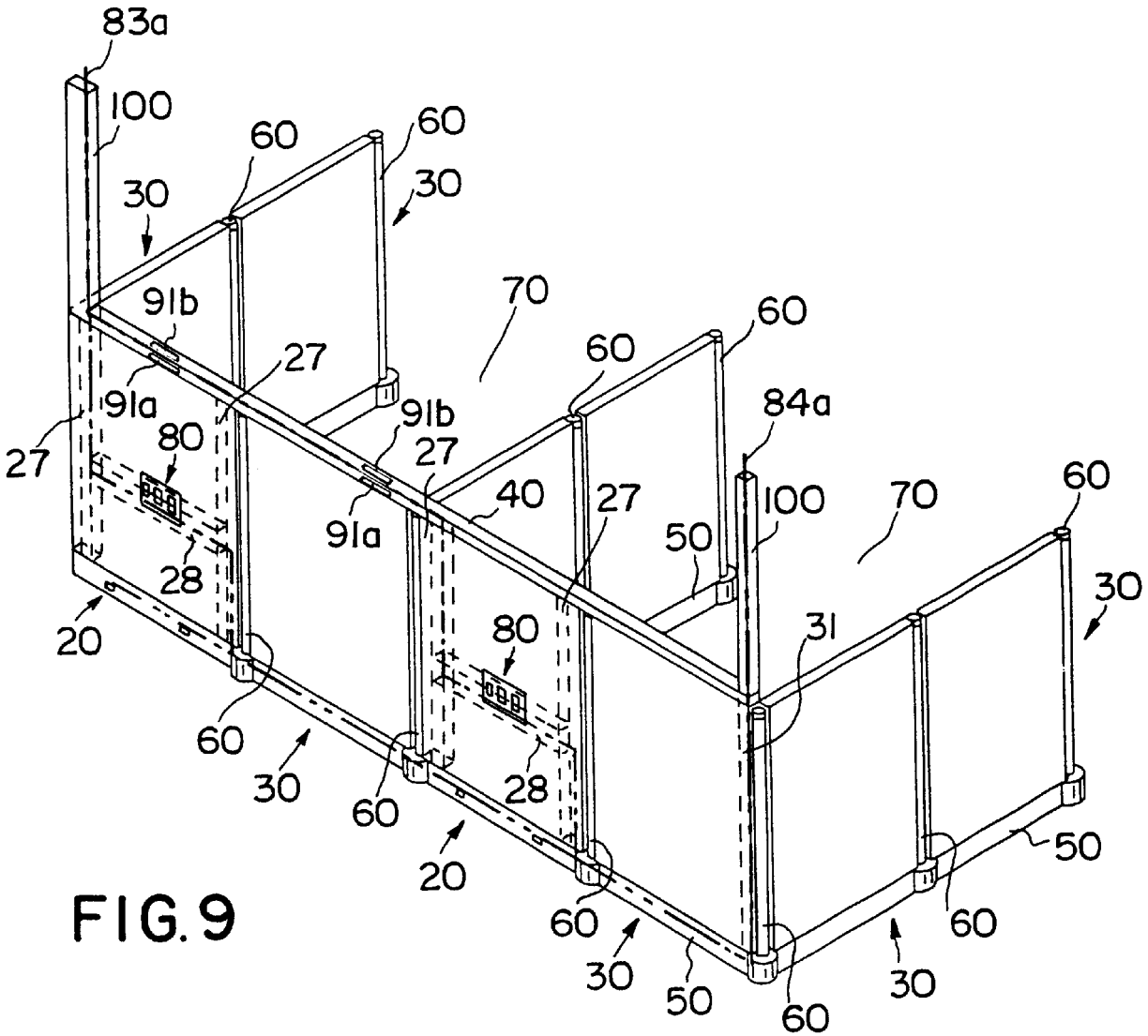
FIG. 9 shows a wiring configuration according to another embodiment of the present invention for the wall panel system shown in FIG. 1.

FIG. 9 shows another method of wiring the work stations 70. In this arrangement, communications lines 83*a* extend downwardly from the office ceiling through pole 100 into race way 40. Similarly, power lines 84*a* extend from the ceiling into another pole 100, down channel 31 and into race way 50. The connections to communications lines 83*a* and power lines 84*a* are made as described above.

Figure 10:
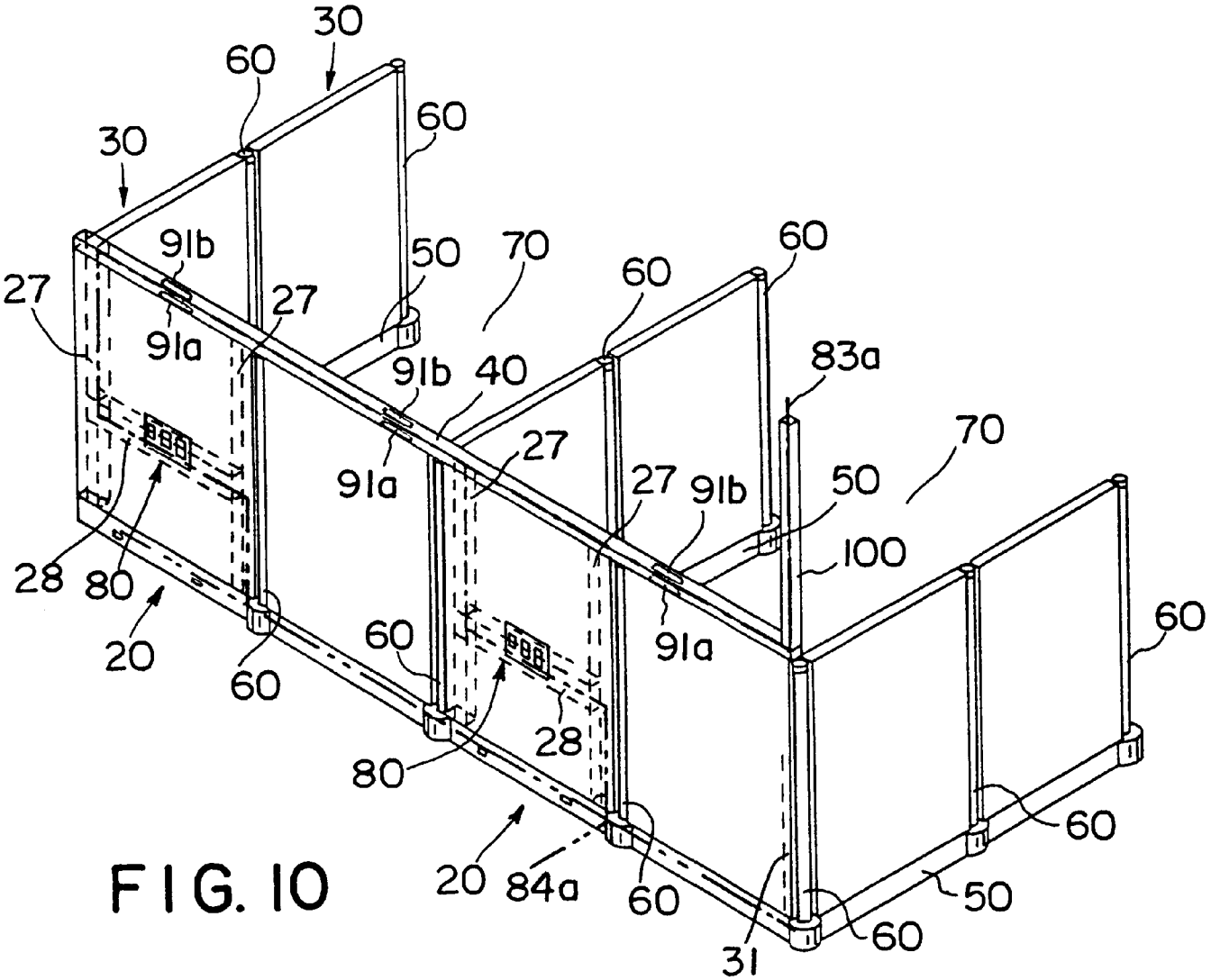
FIG. 10 shows a wiring configuration according to another embodiment of the present invention for the wall panel system shown in FIG. 1.
Figure 11:
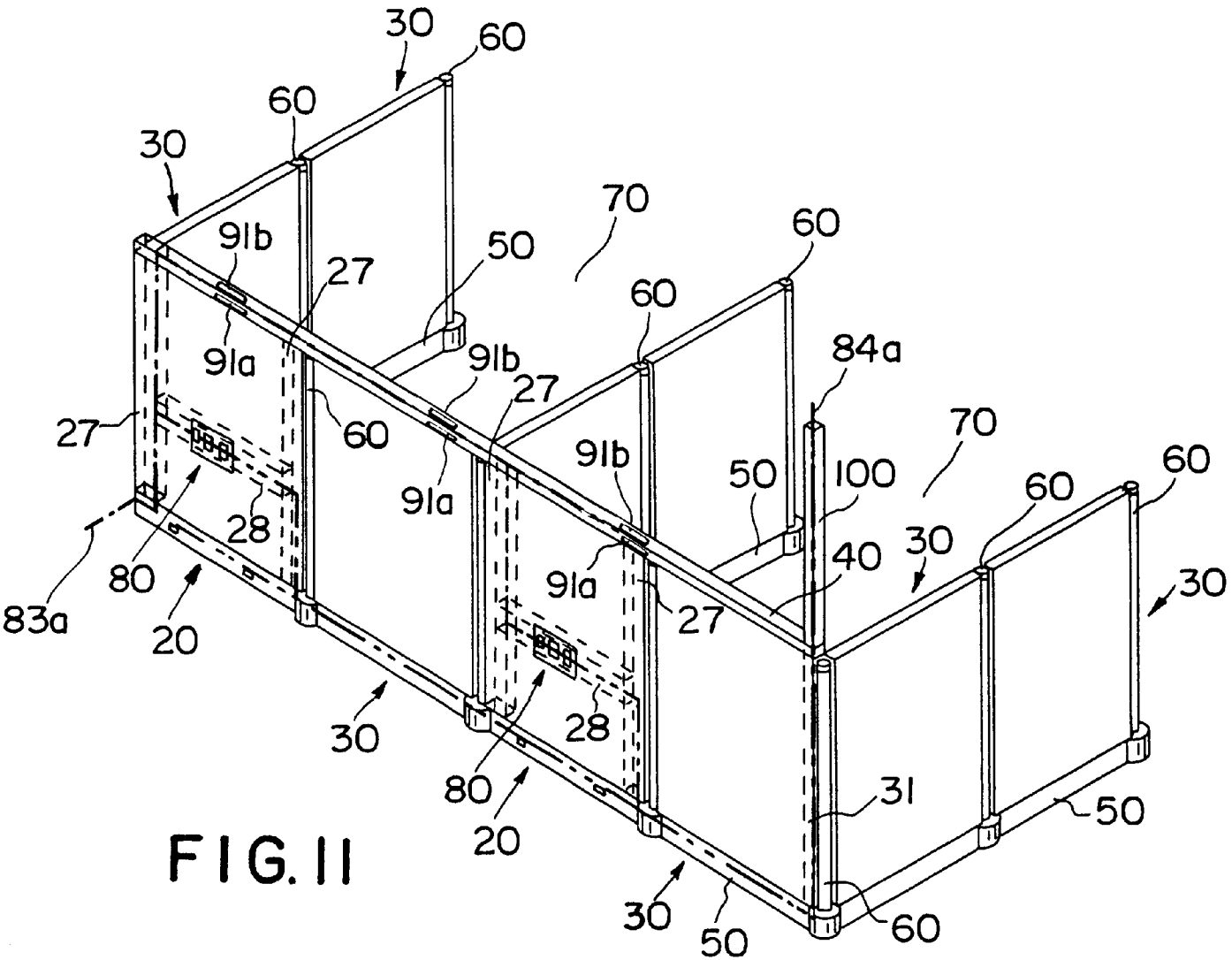
FIG. 11 shows a wiring configuration according to another embodiment of the present invention for the wall panel system shown in FIG. 1.

FIGS. 10 and 11 likewise show alternative wiring arrangements for the system shown in FIG. 1. In FIG. 10, communications lines 83*a* enter the system from above while power lines 84*a* enter from the bottom. In the embodiment of FIG. 11, communications lines 83*a* enter the system from below while power lines 84*a* enter from above.

FIG. 12 likewise illustrates communications lines 83*a* entering the system from below and power lines 84*a* entering the system from above. Note that the embodiment shown in FIG. 12 illustrates how work stations 70 on opposite sides of each other may be provided with access to fiber optics cables 82*a*, communications lines 83*a* and power lines 84*a* through the same assembly 80. This is done by providing an opening in both skins 20*a* and securing face plates 86 to skins 20*a* from both sides of panels 20.

Although the present invention has been shown and described in detail, the same is to be taken by way of example only and not by way of limitation. Numerous changes and modifications can be made to the embodiments shown without departing from the scope of the invention. For example, the panels may be arranged into configurations other than those shown. Similarly, other wiring configurations utilizing the panels may likewise be used. The invention is by no means limited to the specific arrangements shown. If desired, multiple wall panels 20 can be provided at each work station 70. Connectors of other configurations may also be used. Different configurations and locations of channels 27 and 28, race ways 40 and 50 and assemblies 80 can likewise be used. Also, communications lines 83*a* could extend through race way 50 while power lines 84*a* extend through race way 40. Additional electrical outlets could be provided along whichever race way power lines 84*a* are located in. If fewer communications ports 83 are to be used than shown in FIG. 4, blanks could be provided to fill the openings in face plates 86 that receive housings 83*b*. Blanks could also be provided to fill the openings that recieve housings 82*b*. Accordingly, the scope of the present invention is to be limited only by the terms of the attached claims.

What is claimed is:

1. A wall panel, comprising:

a top edge, a bottom edge, a first side edge and a second side edge;

a first raceway having upper and lower portions;

a second raceway having upper and lower portions;

a first vertical channel terminating at and communicating with the lower and upper portions of the first and second raceways, respectively;

a second vertical channel terminating at and communicating with the lower and upper portions of the first and second raceways, respectively; and a horizontal channel communicating with the first and second vertical channels.

2. A wall panel according to claim 1, wherein the first vertical channel is located along the first side edge of the panel.

3. A wall panel according to claim 1, wherein the first raceway is located along the top edge of the panel.

4. A wall panel according to claim 1, wherein the first raceway is located along the bottom edge of the panel.

5. A wall panel according to claim 1, further including a junction assembly located partially within the horizontal channel and partially within the first vertical channel.

6. A wall panel according to claim 1, further including a core member located between the first raceway, the first vertical channel, the second vertical channel and the horizontal channel.

7. A wall panel according to claim 1, further including a first skin extending from the first raceway to the second raceway.

8. A wall panel according to claim 7, wherein the first skin extends from the first vertical channel to the second vertical channel.

9. A wall panel according to claim 1, further including a junction assembly.

10. A wall panel according to claim 9, wherein the junction assembly includes at least one voice communications port.

11. A wall panel according to claim 9, wherein the junction assembly includes at least one data communications port.

12. A wall panel according to claim 9, wherein the junction assembly includes at least one outlet providing access to a source of power.

13. A wall panel according to claim 9 wherein the junction assembly is located at least partially within the horizontal channel.

14. A wall panel according to claim 9, where in the junction assembly is located at least partially within the first vertical channel.

15. A wall panel according to claim 9, wherein the junction assembly is located at least partially within the horizontal channel and at least partially within the first vertical channel.

16. A wall panel according to claim 9, wherein the junction assembly includes at least one fiber optics port.

17. A wall panel, including:

a first raceway having upper and lower portions;

a second raceway having upper and lower portions;

a first vertical channel terminating at and communicating with the lower and upper portions of the first and second raceways, respectively;

a second vertical channel terminating at and communicating with the lower and upper portions of the first and second raceways, respectively;

a horizontal channel communicating with the first and second vertical channels; and at least one communications port located in the horizontal channel.

18. A wall panel according to claim 17, further including a communications line extending from the communications port, through the horizontal channel and into at least one of the vertical channels.

19. A wall panel according to claim 18, wherein the communications line extends out of the vertical channel.

20. A wall panel according to claim 18, further including a connector attached to the communications line.

21. A wall panel according to claim 17, further including at least one electrical outlet located in the horizontal channel.

22. A wall panel according to claim 21, further including a power line extending from the electrical outlet, through the horizontal channel and into at least one of the vertical channels.

23. A wall panel according to claim 22, wherein the power line extends out of the vertical channel.

24. A wall panel according to claim 22, further including a connector attached to the power line.

25. A wall panel according to claim 17, further including at least one fiber optics port located in the horizontal channel.

26. A wall panel according to claim 25, further including a fiber optics cable extending from the fiber optics port, through the horizontal channel and into at least one of the vertical channels.

27. A wall panel according to claim 26, wherein the fiber optics cable extends out of the vertical channel.

28. A wall panel according to claim 26, further including a connector attached to the fiber optics cable.

29. A wall panel according to claim 17, further including at least one fiber optics port located in the first vertical channel.

30. A wall panel according to claim 17, further including a junction assembly located at least partially within the horizontal channel and wherein the communications port is located in the junction assembly.

31. A wall panel according to claim 30, further including at least one electrical outlet located in the junction assembly.

32. A wall panel according to claim 30, further including at least one fiber optics port located in the junction assembly.

33. A wall panel according to claim 32, wherein the junction assembly is located at least partially within the first vertical channel.

34. A wall panel system, including:

a first panel having at least two vertical channels and at least one horizontal channel communicating with the vertical channels;

a second panel located adjacent the first panel;

a first raceway at least partially located above the first and second panels and having upper and lower portions;

a second raceway at least partially located below the first and second panels and having upper and lower portions;

wherein each vertical channel terminates at and communicates with the lower and upper portions of the first and second raceways, respectively;

a communications port and an electrical outlet located in the horizontal channel;

a first communications line located in the first raceway;

a first power line located in the second raceway;

a second communications line extending from the communications port, through the horizontal channel, through one of the vertical channels and into the first raceway; and a second power line extending from the electrical outlet, through the horizontal channel, through one of the vertical channels and into the second raceway.

35. A wall panel system according to claim 34, wherein the first communications line enters the system from above the panels.

36. A wall panel system according to claim 34, wherein the first communications line enters the system from below the panels.

37. A wall panel system according to claim 34, wherein the first power line enters the system from above the panels.

38. A wall panel system according to claim 34, wherein the first power line enters the system from below the panels.

39. A wall panel system according to claim 34, wherein the first power line enters the system from below the panels and the first communications line enters the system from above the panels.

40. A wall panel system according to claim 34, wherein the first power line enters the system from below the panels and the first communications line enters the system from below the panels.

41. A wall panel system according to claim 34, wherein the first power line enters the system from above the panels and the first communications line enters the system from below the panels.

42. A wall panel system according to claim 34, wherein the first power line enters the system from above the panels and the first communications line enters the system from above the panels.

43. A wall panel system according to claim 34, wherein the second panel includes a channel and the first power line extends into the channel.

44. A wall panel system according to claim 43, wherein the channel in the second panel extends vertically through at least a portion of the second panel.

45. A wall panel system according to claim 34, wherein the second panel includes a channel and the first communications line extends into the channel.

46. A wall panel system according to claim 45, wherein the channel in the second panel extends vertically through at least a portion of the second panel.

47. A wall panel according to claim 1, wherein the first race way engages the top edge of the panel and may be removed therefrom as a unit.

48. A wall panel according to claim 1, wherein the first race way includes a removable cap.

49. A wall panel according to claim 17, further including a race way engaging the top edge of the panel, the race way being removable therefrom as a unit.

50. A wall panel according to claim 49, wherein the first race way includes a removable cap.

51. A wall panel system according to claim 34, wherein the first race way engages the top edges of the panels and is removable therefrom as a unit.

52. A wall panel system according to claim 51, wherein the first race way includes a removable cap.

* * * * *